US008538314B2

(12) United States Patent
Yang

(10) Patent No.: US 8,538,314 B2
(45) Date of Patent: Sep. 17, 2013

(54) DUPLEX IMAGE FORMING APPARATUS WITH A SINGLE DRIVE SOURCE

(75) Inventor: Jung-min Yang, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 664 days.

(21) Appl. No.: 12/062,710

(22) Filed: Apr. 4, 2008

(65) Prior Publication Data

US 2009/0035041 A1 Feb. 5, 2009

(30) Foreign Application Priority Data

Aug. 3, 2007 (KR) ..... 10-2007-0078278

(51) Int. Cl.
*G03G 15/00* (2006.01)
*B65H 39/10* (2006.01)

(52) U.S. Cl.
USPC ..... 399/401; 271/301

(58) Field of Classification Search
USPC ..... 399/401, 364, 373, 374; 271/301
See application file for complete search history.

(56) References Cited

U.S. PATENT DOCUMENTS 5,937,262 A * 8/1999 Cho ..... 399/401
6,167,231 A * 12/2000 Blackman et al. ..... 399/364
6,754,456 B2 * 6/2004 Ahn ..... 399/75
6,810,224 B2 * 10/2004 Ahn ..... 399/167
6,885,834 B2 * 4/2005 Ito et al. ..... 399/67
6,966,714 B2 * 11/2005 Harris et al. ..... 400/188
7,260,339 B2 * 8/2007 Carter et al. ..... 399/68
2005/0214011 A1 9/2005 Carter et al.
2006/0269321 A1 * 11/2006 Kang ..... 399/124
2006/0290049 A1 * 12/2006 Fujiwara ..... 271/225
2007/0048052 A1 * 3/2007 Tamehira et al. ..... 399/388
2007/0222144 A1 * 9/2007 Inui et al. ..... 271/291
2008/0042339 A1 * 2/2008 Su et al. ..... 271/264

FOREIGN PATENT DOCUMENTS

JP 2003024491 A * 6/2001
JP 2004-264593 9/2004
KR 1999-20249 3/1999
KR 1999-42562 6/1999
KR 2006-24237 3/2006

OTHER PUBLICATIONS

Machine Translation printed on Mar. 17, 2011, of Japanese Patent Application Publication JP 2003-002491 to Watanabe (Jun. 18, 2001).
Office Action dated Mar. 13, 2013, from Korean Patent Application No. 10-2007-0078278.

* cited by examiner

*Primary Examiner* — Judy Nguyen
*Assistant Examiner* — Justin Olamit
(74) *Attorney, Agent, or Firm* — Staas & Halsey LLP

(57) ABSTRACT

An image forming apparatus includes an image forming unit to form an image on a printing medium; a discharging roller capable of transporting the printing medium which passes through the image forming unit in forward and reverse directions; a driving source to supply a rotation driving force in clockwise and counterclockwise directions to the discharging roller and the image forming unit; a duplex roller to transport the printing medium towards the image forming unit, which was transported in the reverse direction by the discharging roller; and a swing gear unit to receive the rotation driving force in the clockwise and counterclockwise directions to transmit a driving force to the duplex roller in a uniform direction.

20 Claims, 10 Drawing Sheets

DUPLEX IMAGE FORMING APPARATUS WITH A SINGLE DRIVE SOURCE

CROSS-REFERENCE TO RELATED APPLICATION

This application claims all benefits accruing under 35 U.S.C. §119 from Korean Patent Application No. 2007-78278, filed on Aug. 3, 2007, in the Korean Intellectual Property Office, the disclosure of which is incorporated herein by reference.

BACKGROUND OF THE INVENTION

1. Field of the Invention

Example embodiments of the present invention relate to an image forming apparatus, and more particularly, to an image forming apparatus with an improved drive system to reduce manufacturing cost.

2. Description of the Related Art

An image forming apparatus forms an image on a printing medium, and may be classified according to how an image is formed. Various ways of forming the image include an ink jet type method to form the image by discharging an ink, an electrophotographic type method to form the image by proceeding to charge, expose, develop, transfer, and clean to form the image, and a thermal transfer type method to form the image by using an ink ribbon.

The image forming apparatus includes an image forming unit (not shown) to form an image on the printing medium according to one of the above types of forming an image, and a discharging roller to discharge the printing medium having an image formed thereon by way of an image forming unit to the outside of the image forming apparatus. Also, for a double sided printing, that is, for printing on an opposite side of a single sided printed printing medium by passing it through the image forming unit again, some image forming apparatuses have a duplex printing path for transporting the single sided printed printing medium to the image forming unit again. Here, in case of the single sided printing, a discharging roller rotates in a clockwise or a forward direction to discharge the single sided printed printing medium to the outside of the image forming apparatus 100, whereas in case of the double sided printing, the discharging roller rotates in a counterclockwise or a reverse direction to reversely transport the single sided printed printing medium to the duplex printing path.

Also, a duplex roller is disposed on the duplex printing path to transport the printing medium reversely transported by way of the discharging roller to the image forming unit.

However, a typical image forming apparatus includes three driving motors to perform the printing operations, i.e., a first driving motor for driving a rotating body provided in the image forming unit, a second driving motor for driving the discharging roller, and a third driving motor for driving the duplex roller. Accordingly, a manufacturing cost a driving noise increase.

A solution to such problems from using a plurality of driving motors is suggested in co-assigned Korean Patent Publication No. 2006-24237 and No. 1999-20249. In Korean Patent Publication No. 2006-24237, a separate driving source for driving the image forming unit is necessary, so a decrease in a number of the driving source is limited. In Korean Patent Publication No. 1999-20249, a solenoid performing a piston movement is employed, so a driving configuration thereof is complicated, and it is difficult to make a small sized product due to a limitation on space that depends on the piston movement.

SUMMARY OF THE INVENTION

Several aspects and example embodiments of the present invention provide an image forming apparatus having a reduced size.

Another example embodiment of the present invention is to provide an image forming apparatus to drive an image forming unit, a discharging roller, and a duplex roller by way of a single driving source.

Additional example embodiments of the present invention will be set forth in part in the description which follows and, in part, will be obvious from the description, or may be learned by practice of the present invention.

The foregoing and/or other aspects of the present invention can be achieved by providing an image forming apparatus, including an image forming unit to form an image on a printing medium; a discharging roller capable of transporting the printing medium which passes through the image forming unit in forward and reverse directions; a driving source to supply a rotation driving force in clockwise and counterclockwise directions to the discharging roller and the image forming unit; a duplex roller to transport the printing medium toward the image forming unit, which was transported in the reverse direction by the discharging roller; and a swing gear unit to receive the rotation driving force in the clockwise and counterclockwise directions to transmit a driving force to the duplex roller in a uniform direction.

According to an example embodiment of the present invention, the image forming apparatus may further include a frame to support the driving source, wherein the swing gear unit may be disposed to the frame to selectively swing.

According to an example embodiment of the present invention, the image forming apparatus may further include: a driving gear to receive the rotation driving force, and to transmit the rotation driving force to the swing gear unit, and a duplex gear connected to a rotation shaft of the duplex roller, and to receive the rotation driving force from the swing gear unit.

According to an example embodiment of the present invention, the swing gear unit may include: a swing member disposed to the frame to swing to correspond to clockwise and counterclockwise rotations of the driving gear, a first swing gear unit provided in an even number, and disposed to a first side of the swing member to be engaged to the duplex gear when the swing member swings in a first direction, and a second swing gear unit provided in an odd number, and disposed to a second side of the swing member to be engaged to the duplex gear when the swing member swings in a second direction.

According to an example embodiment of the present invention, the image forming apparatus may further include a decelerating gear disposed between the duplex gear and the swing gear unit to receive the rotation driving force from one of the first and second swing gear units, and to transmit the rotation driving force to the duplex gear.

According to an example embodiment of the present invention, the image forming apparatus may further include an aligning roller to receive the rotation driving force from the driving source to align the printing medium which is transported toward the image forming unit and then to transport the printing medium toward the image forming unit.

According to an example embodiment of the present invention, the driving gear may be disposed to an end part of a rotation shaft of the aligning roller.

According to an example embodiment of the present invention, the image forming apparatus may further include an electric clutch disposed to the rotation shaft of the aligning roller to intermittently transmit the rotation driving force to the rotation shaft of the aligning roller.

According to an example embodiment of the present invention, the duplex roller may include a first duplex roller which includes a rotation shaft to which the duplex gear is disposed, and a second duplex roller which interlocks with the first duplex roller to rotate.

According to an example embodiment of the present invention, the image forming apparatus may further include a belt driven by way of the first duplex roller to rotate the second duplex roller.

According to an example embodiment of the present invention, the image forming apparatus may further include a main body to accommodate the image forming unit, the discharging roller, the driving source, the frame, the duplex roller and the swing gear unit, and a duplex supporting frame to rotatably support the first and second duplex rollers, and to be detachably mounted to the main body.

According to an example embodiment of the present invention, the duplex supporting frame may further include an aligning guide to align the printing medium which is transported in the reverse direction by way of the discharging roller.

According to an example embodiment of the present invention, an image forming apparatus to form an image on a medium includes a single driving source to rotate in a medium output direction and a reverse direction to output corresponding rotation driving forces; a duplex transporter to use the rotation driving forces of the single driving source to transport the medium when the image forming apparatus selectively performs two sided image forming operation on the medium; an alignment roller to selectively rotate in the medium output direction or the reverse direction based on the rotation direction of the single driving source; and a swing gear unit attached to an end of the alignment roller to swing about the alignment roller, and to transfer the corresponding rotation driving forces of the single driving source to the duplex transporter, thereby causing the duplex transporter to transport the medium in one direction regardless of a rotation direction of the single driving source.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
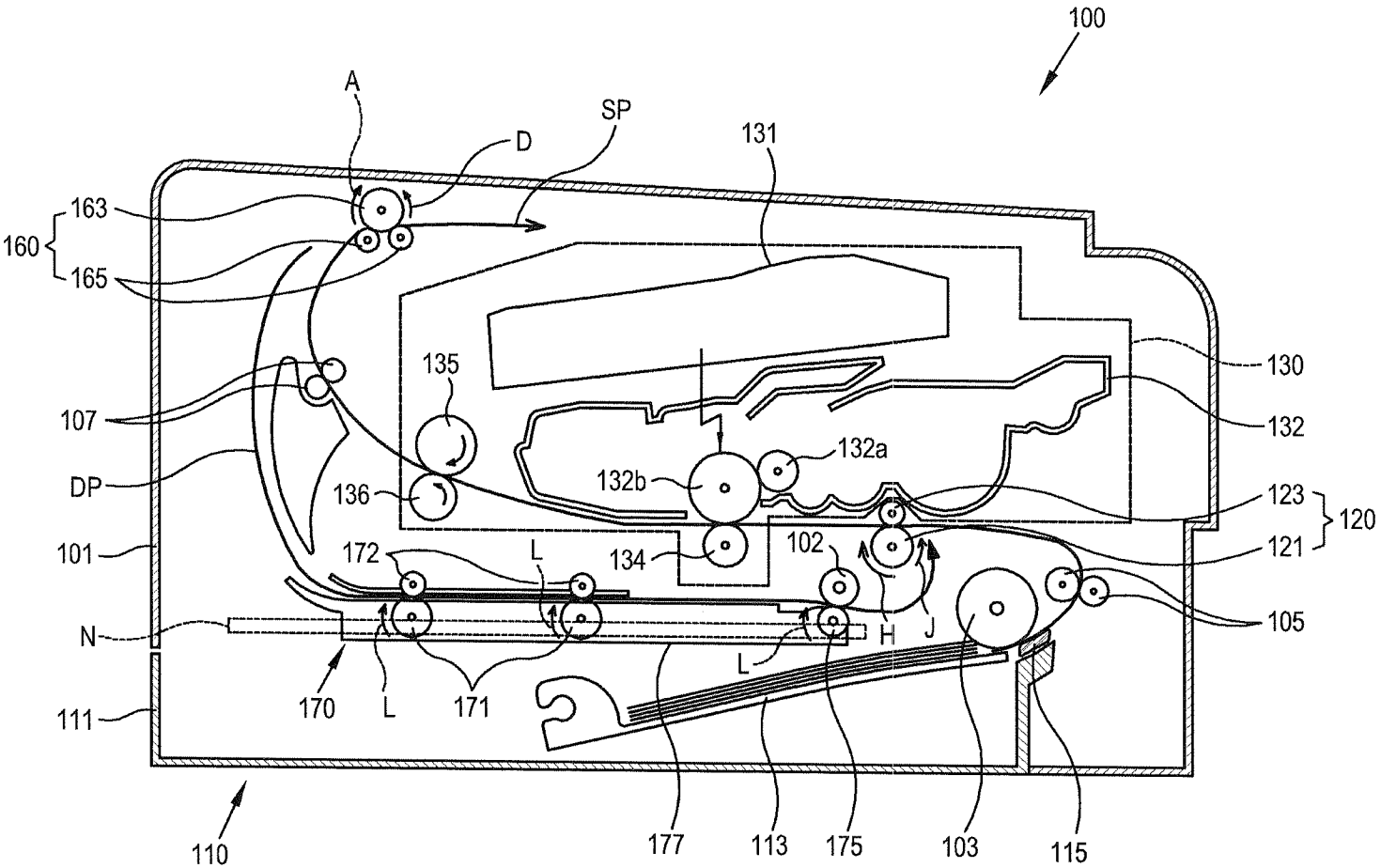
FIG. 1 is a schematic sectional view of an image forming apparatus according to an example embodiment of the present invention.

Reference will now be made in detail to the embodiments of the present invention, examples of which are illustrated in the accompanying drawings, wherein like reference numerals refer to like elements throughout. The example embodiments are described below so as to explain the present invention by referring to the figures.

Figure 2:
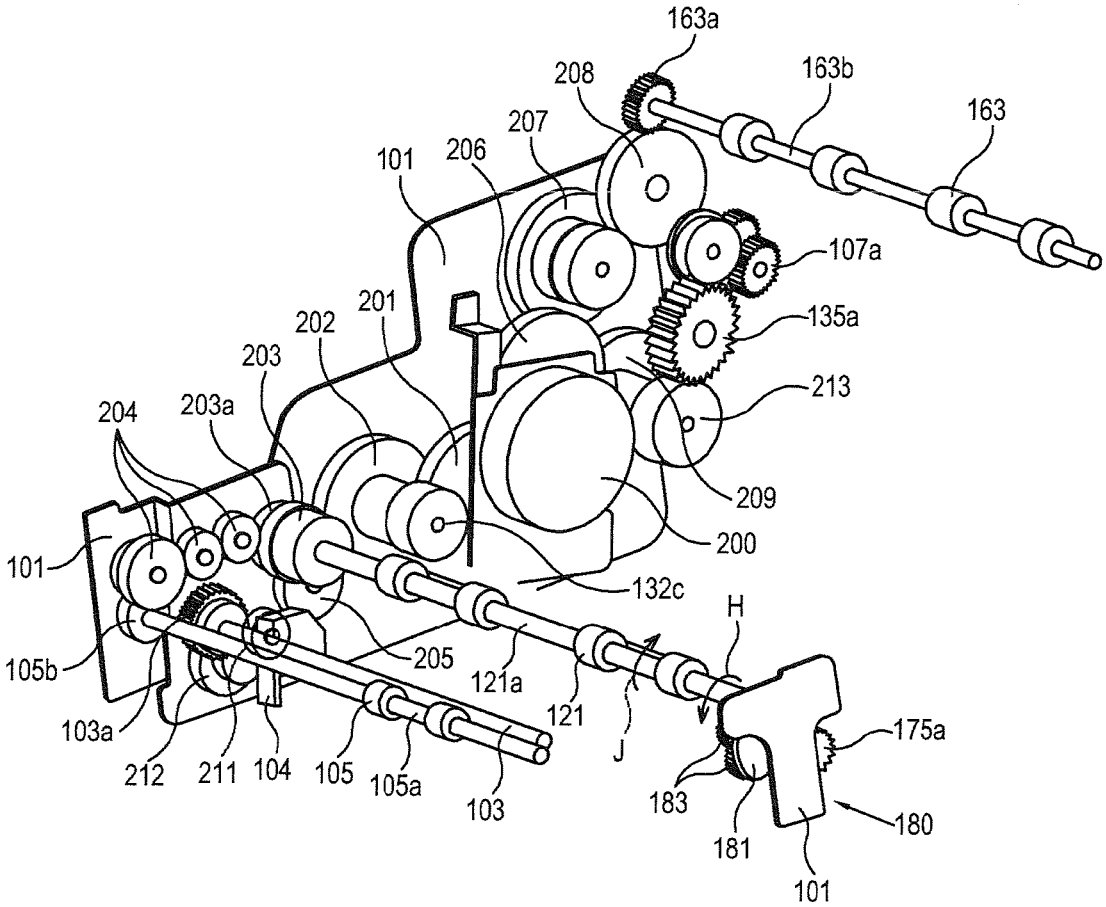
FIG. 2 is a perspective view of a main portion of the image forming apparatus in FIG. 1.

As shown in FIGS. 1 and 2, an image forming apparatus 100 according to an example embodiment of the present invention includes an image forming unit 130, a discharging unit 160, a duplex transporting unit 170, a driving source 200, and a swing gear unit 180. Also, the image forming apparatus 100 includes a simplex (or a single side) printing path SP, along which a printing medium is supplied and a printing of an image is performed on the printing medium by way of the image forming unit 130, and a duplex (or a double side) printing path DP for transporting the printing medium printed along the printing path SP to the image forming unit 130 again to print another image on the other side of the printing medium.

The image forming unit 130 includes a photosensitive body 132*b*, an exposing unit 131 to expose the photosensitive body 132*b* to form an electrostatic latent image on a surface of the photosensitive body 132*b*, and a developing roller 132*a* to develop the electrostatic latent image formed on the surface of the photosensitive body 132*b* with a developer.

The photosensitive body 132*b* and the developing roller 132*a* are accommodated to a developing cartridge 132. The developing cartridge 132 includes a developer storing unit (not shown) to store the developer, and is detachably mounted to a main body 101 of the image forming apparatus 100.

Also, the image forming unit 130 further includes a transferring roller 134 to transfer a visible image formed on the photosensitive body 132*b* by the developing roller 132*a* to the printing medium, and a heating roller 135 and a pressing roller 136 to fuse the transferred visible image on to the printing medium by way of heat and pressure.

The discharging unit 160 may move the printing medium in a forward direction to discharge the printing medium to the outside of the image forming apparatus 100 after passing the printing medium through the image forming unit 130, and may move the printing medium in a reverse direction toward the duplex transporting unit 170.

As shown in FIG. 1, the discharging unit 160 may include a discharging roller 163 capable of rotating in a clockwise direction (or a first direction) and a counterclockwise direction (or a second direction) by the driving source 200, and a plurality of idle rollers 165 that are in contact with the discharging roller 163 to be driven.

Figure 6:
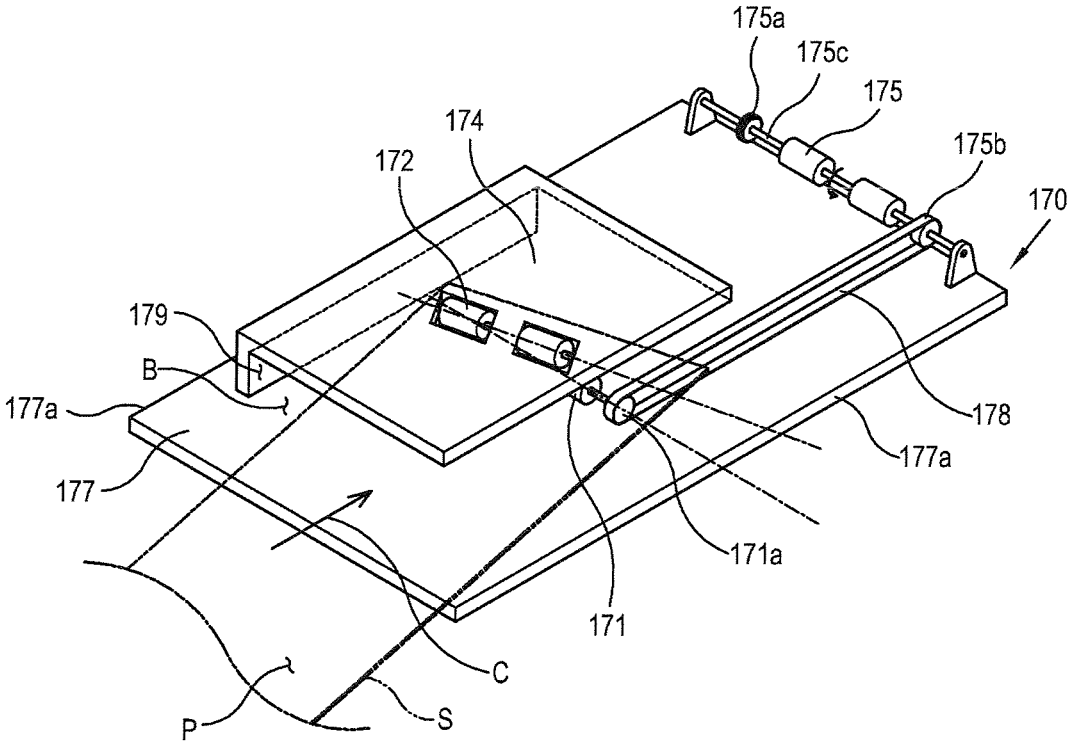
FIG. 6 is a schematic perspective view of a duplex transporting unit of the image forming apparatus in FIG. 1.

As shown in FIGS. 1 and 6, the duplex transporting unit 170 may include a first duplex roller 175, a second duplex roller 171, and a duplex supporting frame 177 to rotatably support the first and second duplex rollers 175 and 171. As shown therein, the second duplex roller 171 is provided in plural. Alternatively, a single second duplex roller 171 may be provided as necessary.

The duplex supporting frame 177 rotatably supports the first and second duplex rollers 175 and 171. Also, the duplex supporting frame 177 may be detachably mounted to the main body 101 of the image forming apparatus 100. An insertion unit 177*a* may be provided to opposite sides of the duplex supporting frame 177 in a lengthwise direction thereof. The duplex supporting frame 177 may be mounted and detached to and from the main body 101 by inserting and extracting the insertion unit 177*a* in and from a sliding guide N, which is shown in FIG. 1 and formed to the main body 101 to have a reverse-U shape. When the duplex supporting frame 177 is mounted and detached to and from the main body 101, a duplex gear 175*a* is engaged and released with and from a decelerating gear 109 (shown in FIG. 3).

The duplex gear 175*a* is disposed to a first end part of a rotation shaft 175*c* of the first duplex roller 175, and a first pulley 175*b* is disposed to a second end part thereof. The duplex gear 175*a* receives a rotation driving force from the driving source 200 through the swing gear unit 180.

The received rotation driving force is transmitted to the second duplex roller 171 through a second pulley 171*a* disposed to the second duplex roller 171 by way of the first pulley 175*b* and a belt 178. For convenience, a single second duplex roller 171 is illustrated. The rotation driving force may be transmitted from the first duplex roller 175 to the second duplex roller 171 by way of other types of transmitting mechanisms instead of the belt as long as the first and second duplex rollers 175 and 171 can rotate in the same directions.

As shown in FIG. 6, the duplex transporting unit 170 may further include an aligning guide 179, a printing medium supporting plate 174, and a printing medium skewing member 172. The aligning guide 179 is coupled to the duplex supporting frame 177 on one side to align the printing medium P that is reversely transported by the discharging roller 163. The printing medium supporting plate 174 extends from the aligning guide 179 to bend, and forms a printing medium moving passage B together with the duplex supporting frame 177.

The printing medium skewing member 172 is disposed to the printing medium supporting plate 174 to rotate about a rotation axis that is inclined with respect to a rotation axis of the second duplex roller 171. Accordingly, the printing medium P that is reversely transported by the discharging roller 163 proceeds slanted toward the aligning guide 179 by way of the printing medium skewing member 172, and a side S of the printing medium P is bumped against the aligning guide 179 so that the printing medium P can be aligned.

Figure 3:
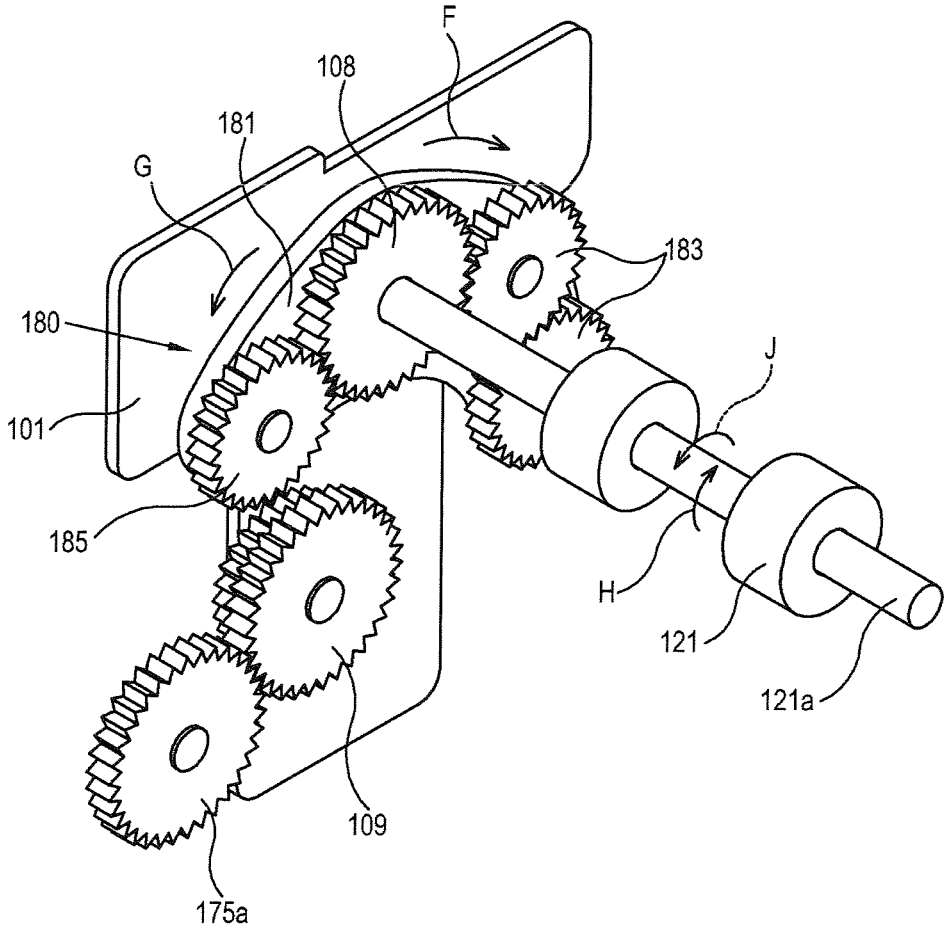
FIG. 3 is an enlarged perspective view of a main portion of the image forming apparatus in FIG. 1.

As shown in FIG. 3, the swing gear unit 180 includes a swing member 181 disposed to the main body 101 to swing, a first swing gear unit 183, and a second swing gear unit 185. As shown in FIG. 3, the swing member 181 swings in a first direction F and a second direction G about an aligning roller shaft 121*a*, which is a rotation shaft of the aligning roller 121. A driving gear 108 may be disposed to a first end part of the aligning roller shaft 121*a*, and an electric clutch 203 shown in FIG. 2 may be disposed to a second end part thereof.

The aligning roller shaft 121*a* is rotatably inserted to the swing member 181 so that the swing member 181 can swing in the first direction F and the second direction G by way of a friction force between the swing member 181 and the aligning roller shaft 121*a*, as the driving gear 108 and the aligning roller shaft 121*a* rotate in a clockwise direction H and a counterclockwise direction J.

Figure 4A:
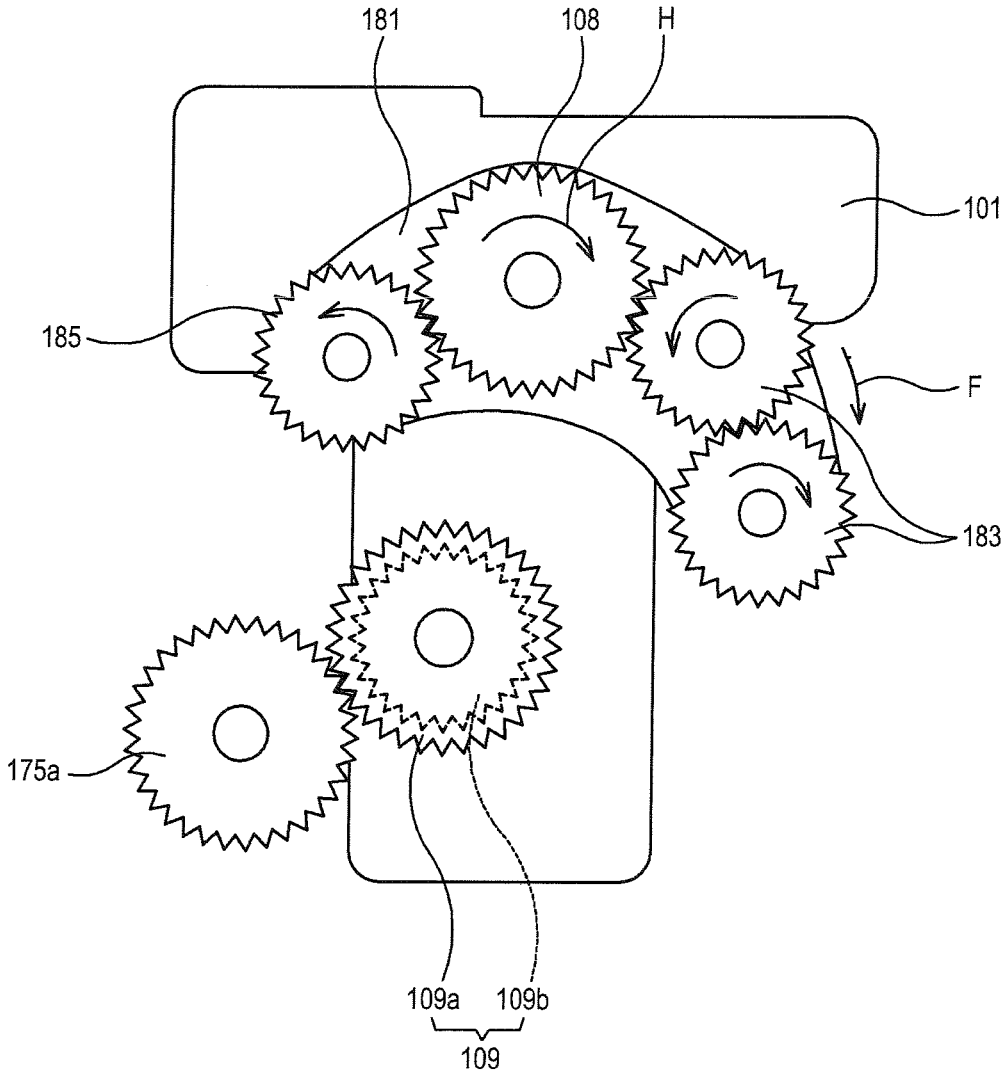
FIGS. 4A and 4B are schematic views illustrating in sequence an operating process of a swing gear unit depending on a clockwise or a first direction rotation of a driving gear of the image forming apparatus in FIG. 1.

The first swing gear unit 183 is disposed to a first side of the swing member 181 to be engaged to the decelerating gear 109 as the swing member 181 swings in the first direction F. As shown in FIG. 4A, the decelerating gear 109 may include a first gear 109*a* and a second gear 109*b* which are coaxial, and may integrally rotate.

The decelerating gear 109 is for changing a rotation number due to a rotation speed difference between the aligning roller 121 and the first duplex roller 175. The decelerating gear 109 may be omitted as necessary. The decelerating gear 109 is engaged with the duplex gear 175*a*.

The second swing gear unit 185 is disposed to a second side of the swing member 181, and is engaged to the decelerating gear 109 to transmit the rotation driving force to the duplex gear 175*a* as the swing member 181 swings in the second direction G. Here, to transmit a rotation force having a uniform direction to the duplex gear 175*a* irrespective of the rotation direction of the aligning roller shaft 121*a*, the first swing gear unit 183 is provided in an even number of gears, and the second swing gear unit 185 is provided in an odd number of gears.

The driving gear 108 is disposed to the aligning roller shaft 121*a*. Alternatively, the driving gear 108 may be connected to a first feeding roller shaft 105*a* shown in FIG. 2 as necessary. However, since the distance to the first duplex roller 175 is large, a separate driving force transmitting mechanism such as a gear or a belt is necessary to transmit the rotation driving force to the duplex gear 175*a* in this case. Accordingly, it is preferable but not necessary to dispose the driving gear 108 to the aligning roller shaft 121*a* that is adjacent to the first duplex roller 175. Also, it is optionally unnecessary to dispose the driving gear 108 to the aligning roller shaft 121*a* in case that the driving gear 108 is provided to rotate about a separate stud (not shown) paralleling the aligning roller shaft 121*a* and inserted to the swing member 181. To connect the driving gear 108 to a rotation shaft of a rotating body existing in the image forming apparatus 100 without the separate stud, it is taken into consideration that the rotation shaft is allowed to rotate in clockwise (or first) and counterclockwise (or second) directions. For example, if the photosensitive body 132*b* rotates in a reverse direction to the rotating direction shown in FIG. 1, the developer accommodated in the developing cartridge 132 may leak. Also, if the heating roller 135 or the pressing roller 136 rotates in a reverse direction to the rotating direction shown in FIG. 1, a problem may happen to a sensor for sensing a surface temperature of the heating roller 135. Accordingly, the driving gear 108 is preferably but not necessarily disposed to the aligning roller shaft 121*a*.

As shown in FIG. 1, the image forming apparatus 100 may further include a printing medium supplying cassette 110, and an aligning unit 120. The printing medium supplying cassette 110 includes a cassette casing 111, a plate 113 accommodated in the cassette casing 111 to load a printing medium, and a friction pad 115 to prevent or reduce the printing medium loaded on the plate 113 from being doubly transported (or more than one printing medium from being transported at a time). The printing medium supplying cassette 110 is detachably mounted to the main body 101 of the image forming apparatus 100.

The aligning unit 120 may include a pair of aligning rollers 121 and 123. One (121) of the pair of the aligning rollers may drive, and the other (123) thereof may be driven. The aligning unit 120 aligns a transported printing medium, and transports the aligned printing medium toward the image forming unit 130.

Also, as shown in FIG. 1, the image forming apparatus 100 according to an example embodiment may further include a pickup roller 103, a first feeding roller 105, and a second feeding roller 107. A second feeding roller gear 107*a* is disposed to an end part of a rotation shaft of the second feeding roller 107. The pickup roller 103 picks up the printing medium loaded on the plate 113, and the picked up printing medium is individually separated by way of the friction force against the friction pad 115 to be transported to the first feeding roller 105.

The first feeding roller 105 is disposed between the pickup roller 103 and the aligning unit 120 to transport the picked up printing medium toward the aligning unit 120. The second feeding roller 107 is disposed between the heating roller 135 and the discharging roller 163 to transport the printing medium passing through the image forming unit 130 toward the discharging roller 163.

As shown in FIG. 2, the driving source 200 may include a single driving motor. The driving source 200 supplies a rotation driving force in clockwise (or first) and counterclockwise (or second) directions to the image forming unit 130, the discharging roller 163, and the duplex roller 175, for example. More in detail, the driving source 200 supplies the rotation driving force to all rotating bodies that are inside the image forming apparatus 100.

Hereinafter, a rotation driving force transmitting course to each component of the image forming apparatus 100 will be described by referring to FIGS. 1 and 2. At first, a first feeding roller gear 105*b* is disposed to an end part of a rotation shaft 105*a* of the first feeding roller 105, and the rotation driving force of the driving source 200 is transmitted to the first feeding roller gear 105*b* through a pinion disposed to a driving shaft (not shown) of the driving source 200 (hereinafter, referred to as a 'driving pinion')→a gear 201→a gear 202→a gear 205→a gear 203*a* of the electric clutch 203→transmitting gears 204.

The pickup roller 103 receives the rotation driving force by way of a gear 205→a gear 211→a gear 212→a pickup roller gear 103*a*. Also, the rotation driving force is intermittently transmitted to the pickup roller 103 by way of a solenoid (not shown).

The rotation driving force of the driving source 200 is intermittently transmitted to the aligning roller 121 by way of the electric clutch 203 disposed to the aligning roller shaft 121*a*. That is, the aligning roller shaft 121*a* is driven or is idle depending on turning on/off of the electric clutch 203.

The heating roller 135 receives the rotation driving force through the driving pinion→a gear 206→a gear 209→a gear 213→a heating roller gear 135*a*. The heating roller gear 135*a* is disposed to a rotation shaft of the heating roller 135, and the pressing roller 136 contacts to the heating roller 135 to be driven. The gear 209 and the gear 213 are coaxially connected. The rotation driving force is transmitted from the gear 209 to the gear 213 only if the driving pinion rotates in the clockwise direction (first or forward direction), and is not transmitted if the driving pinion rotates in the counterclockwise direction (second or reverse direction).

The developing cartridge 132 receives the rotation driving force through a developing cartridge driving gear 132*c*, and the developing roller 132*a* and the photosensitive body 132*b* accommodated therein are driven. The developing cartridge driving gear 132*c* and the gear 202 are coaxially disposed, and the rotation driving force is transmitted from the gear 202 to the developing cartridge driving gear 132*c* only if the driving pinion rotates in the clockwise direction.

A discharging roller gear 163*a* is disposed to a discharging roller shaft 163*b* which is a rotation shaft of the discharging roller 163 to receive the rotation driving force from the driving source 200. The rotation driving force is transmitted to the discharging roller gear 163*a* through the driving pinion→the gear 206→a gear 207→a gear 208. The duplex transporting unit 170 (the first duplex roller 175) receives the rotation driving force of the driving source 200 through the swing gear unit 180.

Figure 4B:
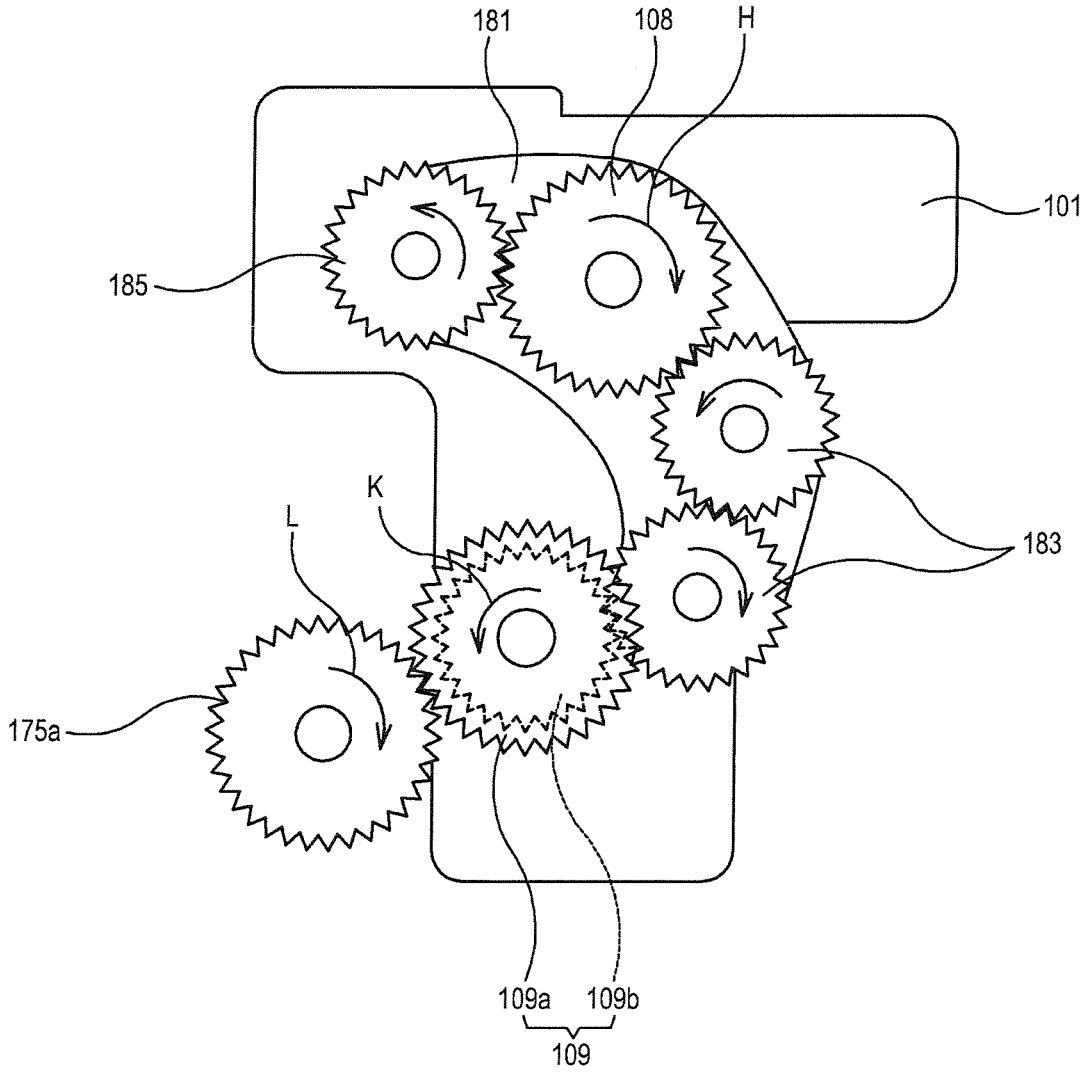

As shown in FIG. 4A, if the driving gear 108 rotates in the clockwise direction H, the first swing gear unit 183 and the second swing gear unit 185 engaged to the driving gear 108 rotate. Also, as shown in FIG. 4B, the swing member 181 swings in the first direction F so that the first swing gear unit 183 can be engaged to the second gear 109*b* of the decelerating gear 109 to rotate the decelerating gear 109 in a counterclockwise direction K. Accordingly, the duplex gear 175*a* can rotate in a clockwise direction L.

Figure 5A:
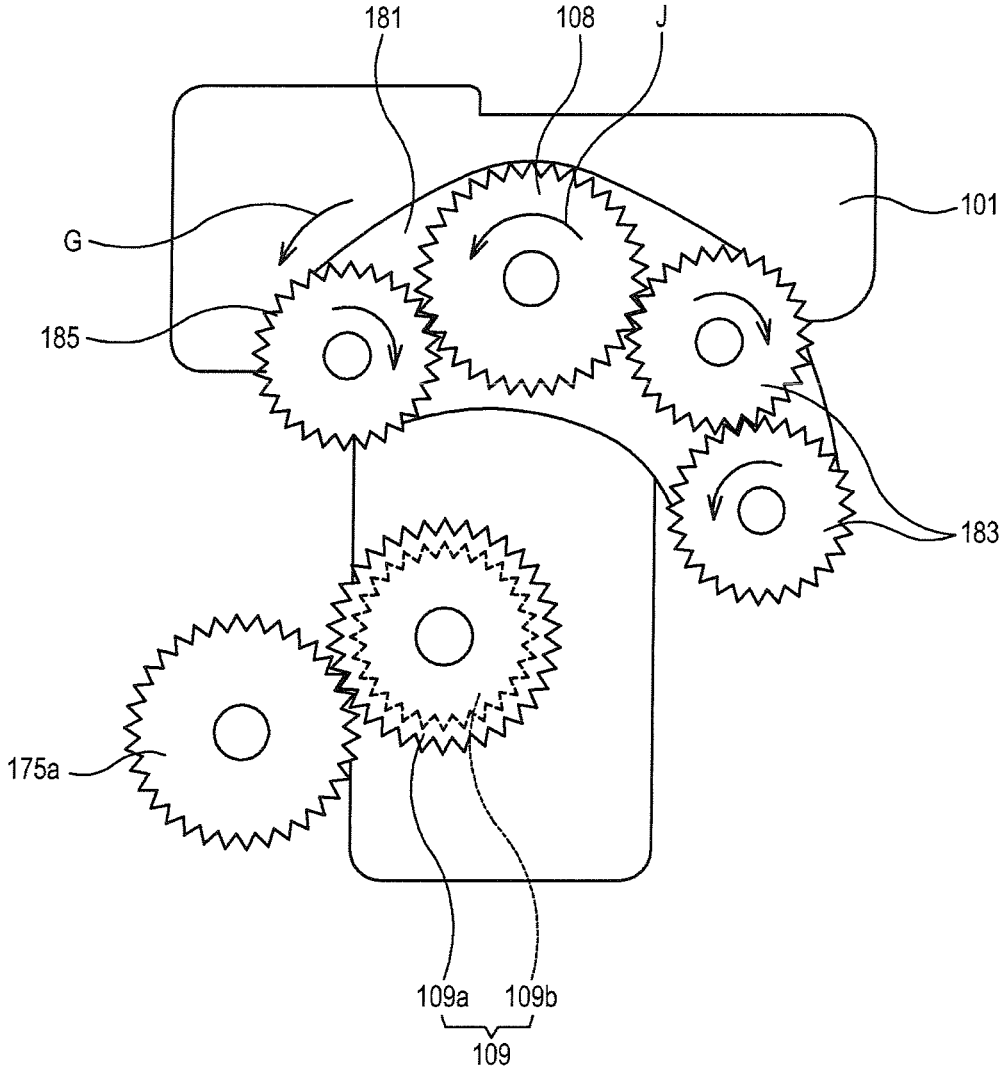
FIGS. 5A and 5B are schematic views illustrating in sequence an operating process of the swing gear unit depending on a counterclockwise or a second direction rotation of the driving gear of the image forming apparatus in FIG. 1.
Figure 5B:
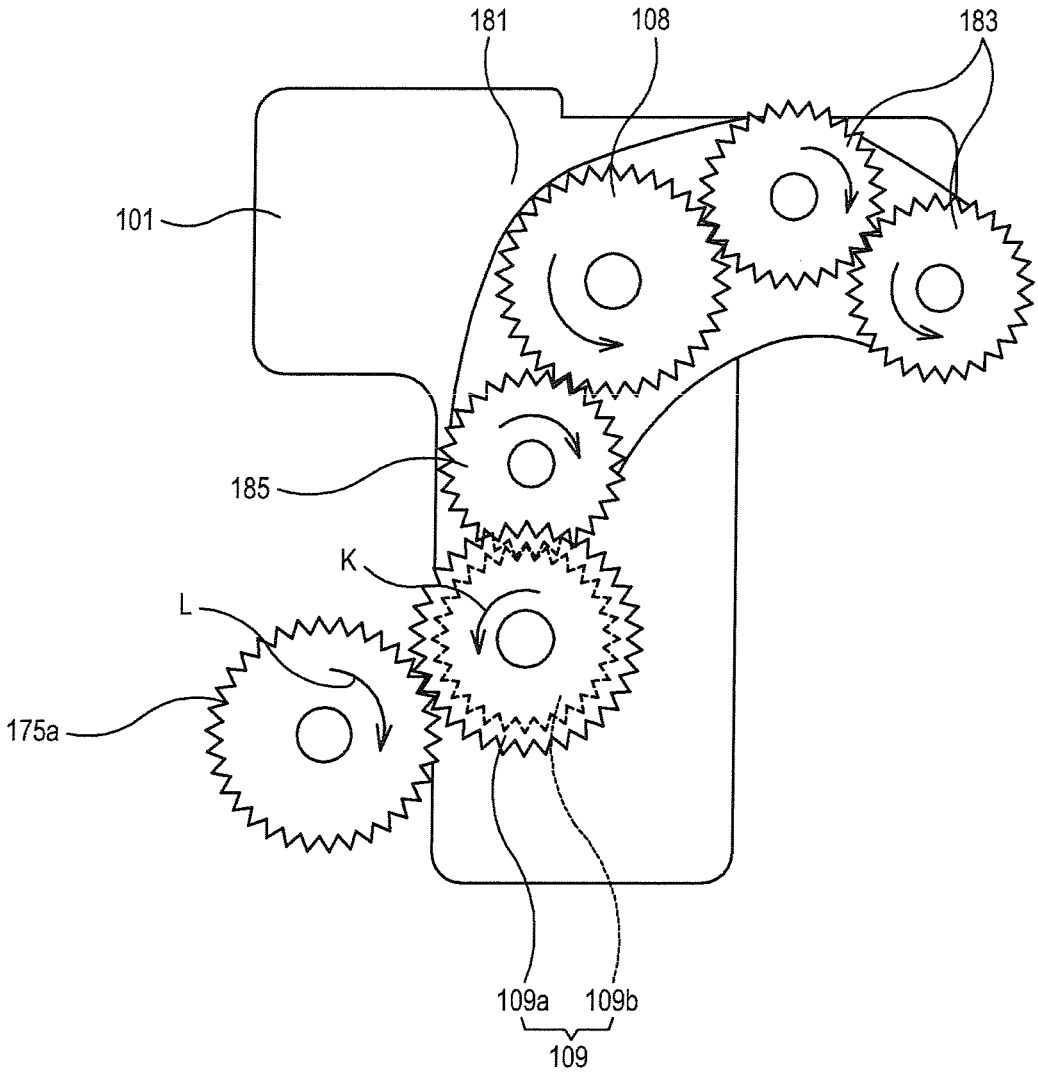

On the other hand, as shown in FIG. 5A, if the driving gear 108 rotates in the counterclockwise direction J, the first swing gear unit 183 and the second swing gear unit 185 rotate in a reverse direction to the direction shown in FIG. 4A. Accordingly, as shown in FIG. 5B, the swing member 181 swings in the second direction G so that the second swing gear unit 185 can be engaged to the second gear 109*b* of the decelerating gear 109, and the decelerating gear 109 can rotate in the counterclockwise direction K which is the same direction as the direction shown in FIG. 4B. Accordingly, the duplex gear 175*a* can rotate in the clockwise direction L as shown in FIG. 4B. That is, the duplex gear 175 can rotate in a uniform direction irrespective of the clockwise and counterclockwise rotations of the driving gear 108. Accordingly, as shown in FIG. 1, the duplex transporting unit 170 can rotate in the direction L in which the printing medium is transported toward the aligning roller 121 irrespective of the clockwise and counterclockwise rotations of the driving source 200.

As described above, if the driving source 200 rotates in the clockwise direction as shown in FIG. 1, each rotating body 103, 105, 121, 132*b*, 132*a*, 134, 135, 107, and 163 accommodated inside the image forming apparatus 100 rotates in a direction for the printing medium to be transported along the simplex printing path SP. On the other hand, if the driving source 200 rotates in the counterclockwise direction, the heating roller 135, the pressing roller 136 and the developing cartridge 132 are idle not to rotate, while the first feeding roller 105, the aligning roller 121, the second feeding roller 107, and the discharging roller 163 rotate in the reverse direction. However, the duplex transporting unit 170 still rotates in the uniform direction L irrespective of the clockwise and counterclockwise rotations of the driving source 200.

Figure 7:
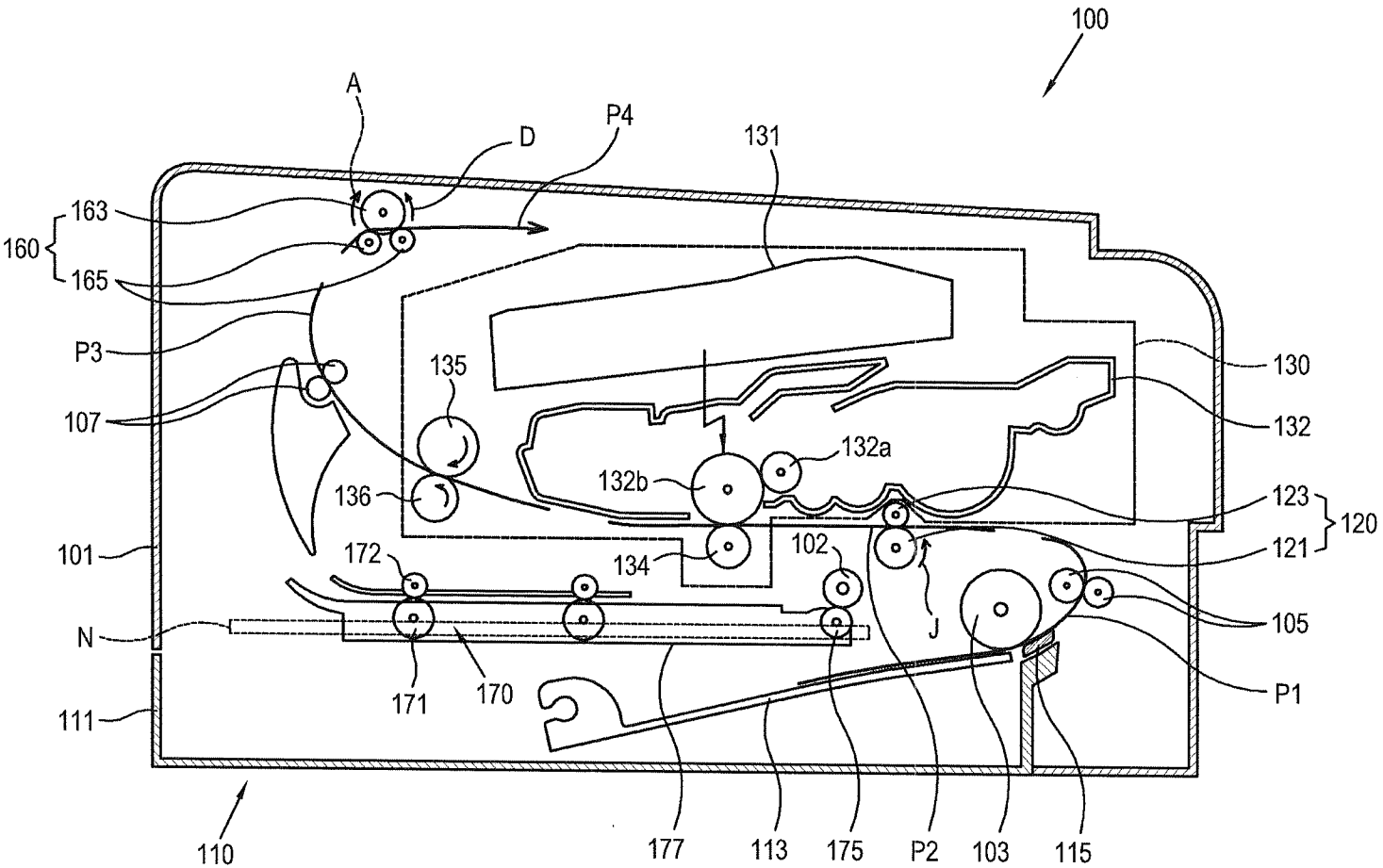
FIG. 7 is a schematic sectional view illustrating a single side printing process of the image forming apparatus in FIG. 1.

Hereinafter, a single side printing process of the image forming apparatus 100 will be described by referring to FIG. 7. Here, P1 to P4 refer to a printing medium moving along the simplex printing path in sequence. A control unit (not shown) rotates the driving source 200 in the clockwise direction, and controls the solenoid (not shown) to transmit the rotation driving force to the pickup roller 103. Accordingly, a printing medium P1 is picked up by the pickup roller 103, and is transported toward the aligning unit 120 through the first feeding roller 105.

The control unit turns off the electric clutch 203 so that the aligning unit 120 can be idle to allow a front end part of the transported printing medium P1 to be bumped to the aligning unit 120. Then, after a predetermined period of time, the control unit turns on the electric clutch 203 to transport the printing medium P1 toward the image forming unit 130. An image developed out of the developer by the image forming unit 130 begins to be formed on the transported printing medium P2.

Then, the printing medium P2 passes through the heating roller 135 and the pressing roller 136, and then the developer is fused on the printing medium P3. Then, the printing medium P4, a single side of which is printed, is discharged to the outside by the discharging roller 163.

Hereinafter, a double side printing process will be described by referring to FIG. 8, which occurs once the single side printing process of the image forming apparatus 100 is completed, but before the printing medium P4 is discharged to the outside by the discharging roller 163. Here, P5 to P8 refer to a printing medium transported in the duplex printing path in sequence during the double side printing process. That is, the control unit rotates the driving source 200 in the counterclockwise direction so that the discharging roller 163 holding the printing medium P4, the single side of which is printed, can rotate in a direction A. Accordingly, the printing medium P4 is transported toward the duplex transporting unit 170. Also, to reduce power consumption, the electric clutch 203 may be turned off until the printing medium P4 enters the second duplex roller 171.

If the printing medium P4 begins to enter in to the second duplex roller 171, the control unit turns on the electric clutch 203 so that the rotation driving force can be transmitted to the first duplex roller 175 and the second duplex roller 171 through the aligning roller shaft 121*a* and the swing gear unit 180. Accordingly, the second duplex roller 171 can rotate in the direction L to hold the printing medium P4 that is reversely transported from the discharging roller 163. The printing medium P5, front and rear end parts of which are respectively held to the second duplex roller 171 and the discharging roller 163, is separated from the discharging roller 163 to be transported toward the first duplex roller 175 as the second duplex roller 171 continuously rotates in the direction L.

Until the printing medium P5 is held to the aligning unit 120, the printing medium P5 can be transported toward the aligning unit 120 irrespective of the clockwise and counterclockwise direction of rotation of the driving source 200. However, the control unit converts the rotation state of the driving source 200 into a clockwise direction rotating state before the front end part of the printing medium P5 enters the aligning unit 120.

Since the driving source 200 is rotated in the counterclockwise direction to rotate the discharging roller 163 in the direction A, the aligning roller 121 rotates in a clockwise direction H as long as the driving source 200 is not under a clockwise rotation state again. Accordingly, the printing medium P5 can be prevented from being held to the aligning unit 120. Although the printing medium P5 is held to the aligning unit 120, since the aligning roller 121 rotates in the clockwise direction H and the first duplex roller 175 rotates in the direction L, the front end part of the printing medium P5 receives a transporting force toward the first duplex roller 175, and the rear end part of the printing medium P5 receives a transporting force toward the aligning roller 121 so that the printing medium P5 can be stagnated (or caught) between the first duplex roller 175 and the aligning unit 120. To solve this problem, the driving source 200 is converted from the counterclockwise rotation state to the clockwise rotation state.

Figure 8:
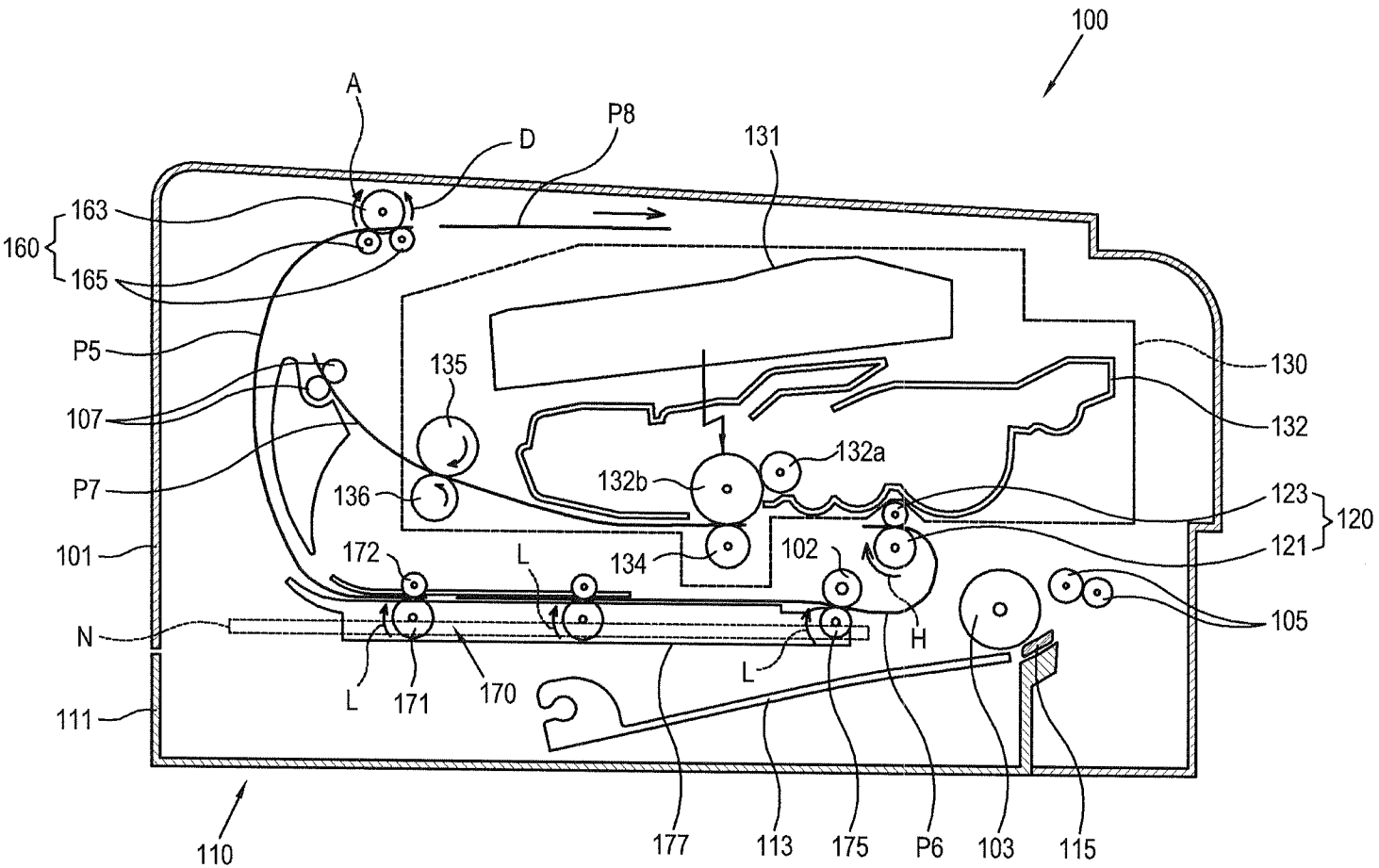
FIG. 8 is a schematic sectional view illustrating an opposite side printing process of the image forming apparatus in FIG. 1.

Since the first duplex roller 175 still rotates in direction L by way of the swing gear unit 180 in FIG. 8, although the driving source 200 is converted to the clockwise rotation state, front and rear end parts of a printing medium P6 are concurrently held so that the printing medium P6 can be transported toward the image forming unit 130. The electric clutch 203 may be turned off after the rear end part of the printing medium P6 passes through the aligning unit 120.

An image is formed on a second side of the printing medium P7 as the printing medium P7 passes through the image forming unit 130. Since the driving source 200 is under the clockwise rotation state, the discharging roller 163 rotates in the direction D to discharge a printing medium P8, the opposite sides of which are printed, to the outside of the image forming apparatus 100. Accordingly, the double side printing process is completed.

As described above, since all rotating bodies inside the image forming apparatus 100 can be rotated by using the single driving source 200 and the swing gear unit 180, a manufacturing cost can be reduced by approximately 15% in comparison with the typical configurations.

As described above, an image forming apparatus according to the present invention has following effects. First, a swing gear unit is employed to reduce the size of a product. Second, an image forming unit, a discharging roller, and a duplex roller are driven by a single driving source to reduce manufacturing cost and driving noise.

While there have been illustrated and described what are considered to be example embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, various types of image forming devices include devices such as photocopiers, printers, facsimile machines, or multifunction peripherals (MFP) (which offer functions of the preceding devices in a single device) commonly have a printing function. Accordingly, it is intended, therefore, that the present invention not be limited to the various example embodiments disclosed, but that the present invention includes all embodiments falling within the scope of the appended claims. Although a few example embodiments of the present invention have been shown and described, it will be appreciated by those skilled in the art that changes may be made in these example embodiments without departing from the principles and spirit of the invention, the scope of which is defined in the appended claims and their equivalents.

What is claimed is:

1. An image forming apparatus, comprising:

an image forming unit to form an image on a printing medium;

a discharging roller to receive the printing medium from a second feeding roller disposed between the discharging roller and the image forming unit, to rotate in a first direction to discharge the printing medium outside of the image forming apparatus after the image is formed on the printing medium, and to rotate in a second direction to transport the printing medium when the image forming apparatus operates in a duplex mode;

a driving source to supply a rotation driving force in clockwise and counterclockwise directions to a discharging roller gear disposed at an end part of a rotation shaft of the discharging roller, the rotation driving force being supplied to the discharging roller gear through a second feeding roller gear disposed to an end part of a rotation shaft of the second feeding roller to the discharging roller gear, and to supply a rotation driving force to the image forming unit;

a duplex transporter, disposed between the discharging roller and the image forming unit, to receive the printing medium from the discharging roller and to transport the printing medium toward the image forming unit;

a swing gear unit to receive the rotation driving force in the clockwise and counterclockwise directions to transmit a driving force to the duplex transporter in a uniform rotation direction; and an aligning roller to receive the rotation driving force from the driving source to align the printing medium which is transported toward the image forming unit from the duplex transporter and then to transport the printing medium toward the image forming unit, wherein the swing gear unit further comprises a driving gear to receive the rotation driving force, and to transmit the rotation driving force to the swing gear unit, wherein the driving gear is disposed to an end part of a rotation shaft of the aligning roller, and wherein the driving source further supplies a rotation driving force to a pickup roller, a first feed roller, the second feed roller, a developing cartridge, the discharging roller, and the duplex transporter.

2. The image forming apparatus according to claim 1, further comprising a frame to support the driving source, wherein the swing gear unit is disposed to the frame to selectively swing.

3. The image forming apparatus according to claim 2, further comprising:

a duplex gear connected to a rotation shaft of the duplex transporter, and to receive the rotation driving force from the swing gear unit.

4. The image forming apparatus according to claim 3, wherein the swing gear unit comprises:

a swing member disposed to the frame to swing to correspond to clockwise and counterclockwise rotations of the driving gear, a first swing gear set provided in an even number, and disposed to a first side of the swing member to be engaged to the duplex gear when the swing member swings in a first direction, and a second swing gear set provided in an odd number, and disposed to a second side of the swing member to be engaged to the duplex gear when the swing member swings in a second direction.

5. The image forming apparatus according to claim 4, further comprising a decelerating gear disposed between the duplex gear and the swing gear unit capable of receiving the rotation driving force directly from either the first or second swing gear set, wherein the decelerating gear transmits the rotation driving force to the duplex gear.

6. The image forming apparatus according to claim 3, wherein the duplex transporter comprises:

a first duplex roller which comprises a rotation shaft to which the duplex gear is disposed, and a second duplex roller which interlocks with the first duplex roller to rotate.

7. The image forming apparatus according to claim 6, further comprising a belt driven by way of the first duplex roller to rotate the second duplex roller.

8. The image forming apparatus according to claim 6, further comprising:

a main body to accommodate the image forming unit, the discharging roller, the driving source, the frame, the duplex transporter, and the swing gear unit, and a duplex supporting frame to rotatably support the first and second duplex rollers, and to be detachably mounted to the main body.

9. The image forming apparatus according to claim 8, wherein the duplex supporting frame further comprises an aligning guide to align the printing medium which is transported from the discharging roller.

10. The image forming apparatus according to claim 1, further comprising an electric clutch disposed to the rotation shaft of the aligning roller to intermittently transmit the rotation driving force to the rotation shaft of the aligning roller.

11. The image forming apparatus of claim 1, wherein the aligning roller further receives the rotation driving force from the driving source to align the printing medium when it is transported toward the image forming unit from the first feeding roller and then transports the printing medium toward the image forming unit.

12. An image forming apparatus to form an image on a medium, comprising:

a single driving source to rotate in a medium output direction and a reverse direction to output corresponding rotation driving forces to rotating bodies inside the image forming apparatus;

a discharging roller to receive a rotation driving force from the single driving source in clockwise and counterclockwise directions via a discharging roller gear disposed at an end part of a rotation shaft of the discharging roller, to receive the medium from a second feeding roller disposed between the discharging roller and an image forming unit which forms an image on the medium, to rotate in a first direction to discharge the medium outside of the image forming apparatus after the image is formed on the medium, and to rotate in a second direction to transport the printing medium when the image forming apparatus operates in a duplex mode, wherein the rotation driving force is received by the discharging roller gear from the single driving source through a second feeding roller gear disposed to an end part of a rotation shaft of the second feeding roller gear;

a duplex transporter, disposed between the discharging roller and the image forming unit, to receive the medium from the discharging roller and to use the rotation driving forces of the single driving source to transport the medium toward the image forming unit when the image forming apparatus selectively performs two sided image forming operation on the medium;

an alignment roller to selectively rotate in the medium output direction or the reverse direction based on the rotation direction of the single driving source, wherein the alignment roller aligns the medium when it is transported from the duplex transporter toward an image forming unit and transports the medium toward the image forming unit;

a swing gear unit attached to an end of the alignment roller to swing about the alignment roller, and to transfer the corresponding rotation driving forces of the single driving source to the duplex transporter, thereby causing the duplex transporter to transport the medium in one direction regardless of a rotation direction of the single driving source; and a driving gear to receive the rotation driving forces, and to transmit the rotation driving forces to the swing gear unit, and wherein the driving gear is disposed to an end part of a rotation shaft of the alignment roller, wherein the single driving source further supplies a rotation driving force to the image forming unit, a pickup roller, a first feed roller, the second feed roller, the discharging roller, and a developing cartridge.

13. The image forming apparatus of claim 12, wherein the swing gear unit swings in a first direction to transfer the medium output direction rotation driving force of the single driving source to the duplex transporter.

14. The image forming apparatus of claim 13, wherein the medium output direction rotation driving force of the single driving source causes the swing gear unit to swing in the first direction.

15. The image forming apparatus of claim 13, wherein the swing gear unit swings in a second direction opposite the first direction to transfer the reverse direction rotation driving force of the single driving source to the duplex transporter.

16. The image forming apparatus of claim 15, wherein the reverse direction rotation driving force of the single driving source causes the swing gear unit to swing in the second direction.

17. The image forming apparatus of claim 12, wherein the swing gear unit uses an even number of gears to transfer the medium output direction rotation driving force of the single driving source to the duplex transporter.

18. The image forming apparatus of claim 17, wherein the swing gear unit uses an odd number of gears to transfer the reverse direction rotation driving force of the single driving source to the duplex transporter.

19. An image forming apparatus, comprising:

an image forming unit to form an image on a printing medium;

a discharging roller to receive the printing medium from a second feeding roller disposed between the discharging roller and the image forming unit, to rotate in a first direction to discharge the printing medium outside of the image forming apparatus after the image is formed on the printing medium, and to rotate in a second direction to transport the printing medium when the image forming apparatus operates in a duplex mode;

a driving source to supply a rotation driving force in clockwise and counterclockwise directions to a discharging roller gear disposed at an end part of a rotation shaft of the discharging roller, the rotation driving force being supplied to the discharging roller gear through a second feeding roller gear disposed to an end part of a rotation shaft of the second feeding roller to the discharging roller gear, and to supply a rotation driving force to the image forming unit;

a duplex transporter, disposed between the discharging roller and the image forming unit, to transport the printing medium toward the image forming unit, which was transported in the reverse direction from the discharging roller, wherein the duplex transporter further comprises a first duplex roller, a second duplex roller, and a duplex gear connected to a rotation shaft of the first duplex roller of the duplex transporter;

a skewing member disposed within the duplex transporter, to transport the printing medium which is reversely transported from the discharging roller, wherein the skewing member rotates about an inclined rotation axis with respect to a rotation axis of the second duplex roller;

a swing gear unit to receive the rotation driving force in the clockwise and counterclockwise directions to transmit a driving force to the duplex transporter in a uniform rotation direction;

a frame to support the driving source, wherein the swing gear unit is disposed to the frame to selectively swing, wherein the swing gear unit further comprises:

a swing member disposed to the frame to swing about an aligning roller shaft of an aligning roller, to correspond to clockwise and counterclockwise rotations of a driving gear disposed to an end part of the aligning roller shaft of the aligning roller, a first swing gear set provided in an even number, and disposed to a first side of a swing member to be engaged to the duplex gear when the swing member swings in a first direction, and a second swing gear set provided in an odd number, and disposed to a second side of the swing member to be engaged to the duplex gear when the swing member swings in a second direction;

and a decelerating gear disposed between the duplex gear and the swing gear unit capable of receiving the rotation driving force directly from either the first or second swing gear set, wherein the decelerating gear transmits the rotation driving force to the duplex gear, and wherein the decelerating gear corrects for a rotation speed difference between the aligning roller and the first duplex roller, wherein the driving source further supplies a rotation driving force to a pickup roller, a first feed roller, the second feed roller, a developing cartridge, the discharging roller, and the duplex transporter.

20. The image forming apparatus of claim 19, wherein the decelerating gear comprises a first gear and a second gear which are coaxial and integrally rotate.

* * * * *